US007960906B2

(12) United States Patent
Lee et al.

(10) Patent No.: US 7,960,906 B2
(45) Date of Patent: Jun. 14, 2011

(54) ELECTRON EMISSION DEVICE, LIGHT EMISSION APPARATUS INCLUDING THE SAME, AND METHOD OF MANUFACTURING THE ELECTRON EMISSION DEVICE

(75) Inventors: So-Ra Lee, Suwon-si (KR); Jae-Myung Kim, Suwon-si (KR); Yoon-Jin Kim, Suwon-si (KR); Hee-Sung Moon, Suwon-si (KR); Kyu-Nam Joo, Suwon-si (KR); Hyun-Ki Park, Suwon-si (KR); Young-Suk Cho, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 212 days.

(21) Appl. No.: 12/145,687

(22) Filed: Jun. 25, 2008

(65) Prior Publication Data

US 2009/0072707 A1 Mar. 19, 2009

(30) Foreign Application Priority Data

Sep. 17, 2007 (KR) ..... 10-2007-0094160

(51) Int. Cl.
*H01J 1/62* (2006.01)

(52) U.S. Cl. ..... 313/495; 313/310

(58) Field of Classification Search ..... 313/495–496, 313/309–310, 336, 351
See application file for complete search history.

(56) References Cited

U.S. PATENT DOCUMENTS

| | | | | |
|---|---|---|---|---|
| 7,683,531 | B2 * | 3/2010 | Lin et al. | 313/497 |
| 2002/0060514 | A1 | 5/2002 | Nakamoto | |
| 2005/0152155 | A1 | 7/2005 | Kang et al. | |
| 2006/0061257 | A1 | 3/2006 | Nakamoto | |
| 2006/0232180 | A1 | 10/2006 | Kang et al. | |
| 2007/0057621 | A1 | 3/2007 | Cho et al. | |

FOREIGN PATENT DOCUMENTS

| | | | |
|---|---|---|---|
| JP | 2000-251620 | | 9/2000 |
| KR | 1020050050979 | A | 6/2005 |
| KR | 1020060114865 | A | 11/2006 |

OTHER PUBLICATIONS

KIPO Registration Determination Certificate, dated Dec. 19, 2008, for priority Korean application 10-2007-0094160, noting listed references in this IDS.

European Search Report dated Apr. 28, 2010, for corresponding European Patent application 08161859.7, noting the listed references were previously filed in an IDS dated Jul. 21, 2010, as well as KR 2006-0114865 previously filed in an IDS dated Mar. 10, 2009.

* cited by examiner

*Primary Examiner* — Vip Patel
(74) *Attorney, Agent, or Firm* — Christie, Parker & Hale, LLP

(57) ABSTRACT

Electron emission devices include first electrodes on a substrate extending in a first direction and spaced apart from each other. Second electrodes are on the substrate alternating between the first electrodes and extending in a second direction opposing the first direction. First electron emitters and second electron emitters are on side surfaces of the first electrodes and the second electrodes, respectively. Gaps are formed between the first electron emitters and second electron emitters.

10 Claims, 5 Drawing Sheets

ELECTRON EMISSION DEVICE, LIGHT EMISSION APPARATUS INCLUDING THE SAME, AND METHOD OF MANUFACTURING THE ELECTRON EMISSION DEVICE

CROSS-REFERENCE TO RELATED PATENT APPLICATION

This application claims priority to and the benefit of Korean Patent Application No. 10-2007-0094160, filed on Sep. 17, 2007, in the Korean Intellectual Property Office, the entire content of which is incorporated herein by reference.

BACKGROUND OF THE INVENTION

1. Field of the Invention

The present invention relates to light emission devices which include electron emission units, and, more particularly, to electron emission units having a plurality of electron emission devices which include patterned electron emitters.

2. Description of the Related Art

Light emission apparatuses typically include front substrates on which anode electrodes and phosphor layers are formed, and rear substrates on which electron emitters and driving electrodes are formed. Both edges of the front and rear substrates are integrally bonded via sealing members, and inner spaces thereof are exhausted, so that the front and rear substrates and the sealing members constitute vacuum containers.

The driving electrodes and cathode electrodes that are disposed parallel to the driving electrodes form gate electrodes. The electron emitters are typically disposed on side surfaces of the cathode electrodes facing the gate electrodes. The driving electrodes and the electron emitters form electron emission units.

Metal reflective layers may be disposed on one surface of the phosphor layers facing the rear substrates. The metal reflective layers reflect toward the front substrates visible light which is emitted from the phosphor layers in order to increase brightness. The anode electrodes, the phosphor layers, and the metal reflective layers form light emission units.

The light emission apparatuses apply a predetermined driving voltage to the cathode electrodes and the gate electrodes, and apply a direct current voltage (anode voltage) that is more than several thousands of volts to the anode electrodes. Electric fields are generated around the electron emitters by a voltage difference between the cathode electrodes and the gate electrodes. Electrons are discharged from the electric fields, and the electrons are drawn to the anode voltage and collide with the corresponding phosphor layers. The phosphor layers are then excited to emit visible light.

Conventional methods of forming electron emitters depend upon a specific shape of the electron emitters of a light emission apparatus. Therefore, a method of manufacturing the electron emitters is limited to the shape of the electron emitters, and thus the material for the electron emitters becomes limited.

Furthermore, the shape of conventional electron emitters has low manufacturing precision making it very difficult to manufacture a light emission apparatus having desired luminous efficiency.

SUMMARY OF THE INVENTION

In accordance with present invention electron emission devices and methods of manufacturing an electron emission device for use in a light emission apparatus are provided.

According to an exemplary embodiment of the present invention, an electron emission device includes first electrodes disposed on a substrate, the first electrodes extending in a first direction and spaced apart from each other. Second electrodes are disposed on the substrate, alternating between the first electrodes in a second direction and extending in a second direction opposing the first direction. First electron emitters and second electron emitters are disposed on side surfaces of the first electrodes and the second electrodes, respectively. Gaps are formed between the first electron emitters and second electron emitters.

According to another exemplary embodiment of the present invention, there is provided a light emission apparatus having a first substrate and a second substrate disposed to face each other. An electron emission unit is disposed on a surface of the first substrate and includes a plurality of electron emission devices. A metal reflection film is formed on a surface of the second substrate. A light emission unit includes phosphor layers formed on a surface of the metal reflection film facing the first substrate. Each of the electron emission devices includes first electrodes disposed on a substrate, the first electrodes extending in a first direction and spaced apart from each other. Second electrodes are disposed alternating between the first electrodes and extending in a second direction opposing the first direction. First electron emitters and second electron emitters are disposed on side surfaces of the first electrodes and the second electrodes, respectively. Gaps are formed between the first electron emitters and second electron emitters.

According to another exemplary embodiment of the present invention, there is provided a method of manufacturing electron emission devices. The method includes: forming alternately first electrodes and second electrodes parallel to the first electrodes on a first substrate; forming electron emission layers between the first electrodes and the second electrodes; and forming gaps between the electron emission layers by removing a part of the electron emission layers.

The height of the first electron emitters and second electron emitters may be smaller than the height of the first electrodes and the second electrodes, respectively.

The width of the gaps may be less than 20 μm.

The width of the gaps may be between about 3 μm and 20 μm.

The first electron emitters may be spaced apart from each other in a lengthwise direction along the first electrodes.

The second electron emitters may be spaced apart from each other in a lengthwise direction along the second electrodes.

The first electron emitters and second electron emitters may include a carbide-driven carbon.

The electron emission devices may further include patterns which are arranged in at least one of the gaps on the surface of the substrate.

The gaps may be formed by patterning the electron emission layers using laser.

DETAILED DESCRIPTION

Figure 1:
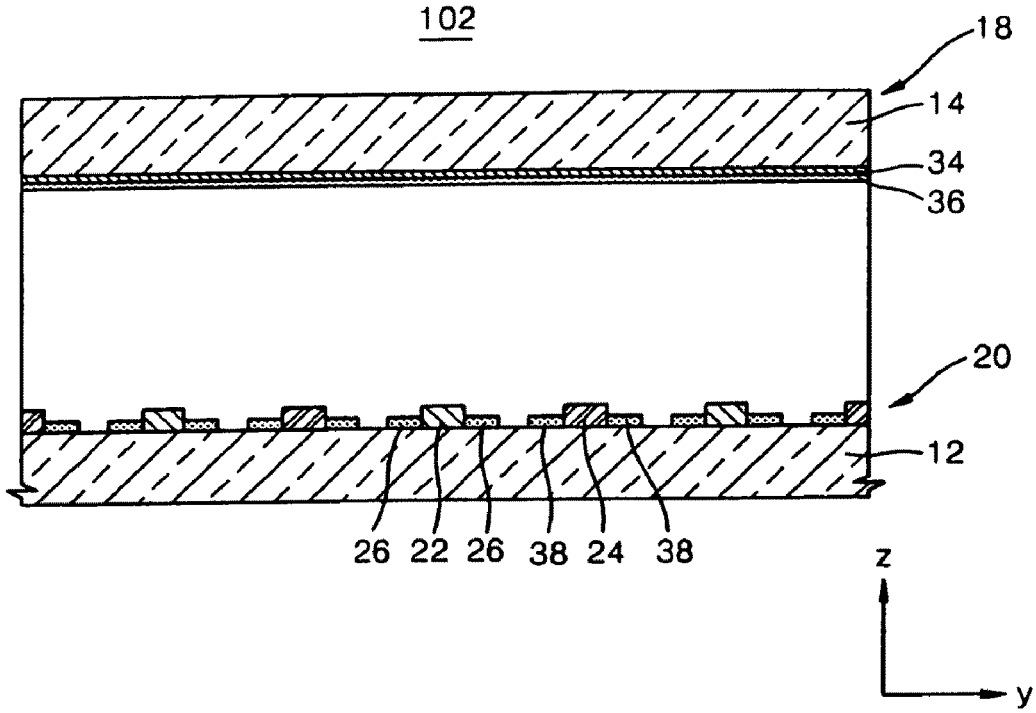
FIG. 1 is a partial cross-sectional view of a light emission apparatus according to an embodiment of the present invention.
Figure 2:
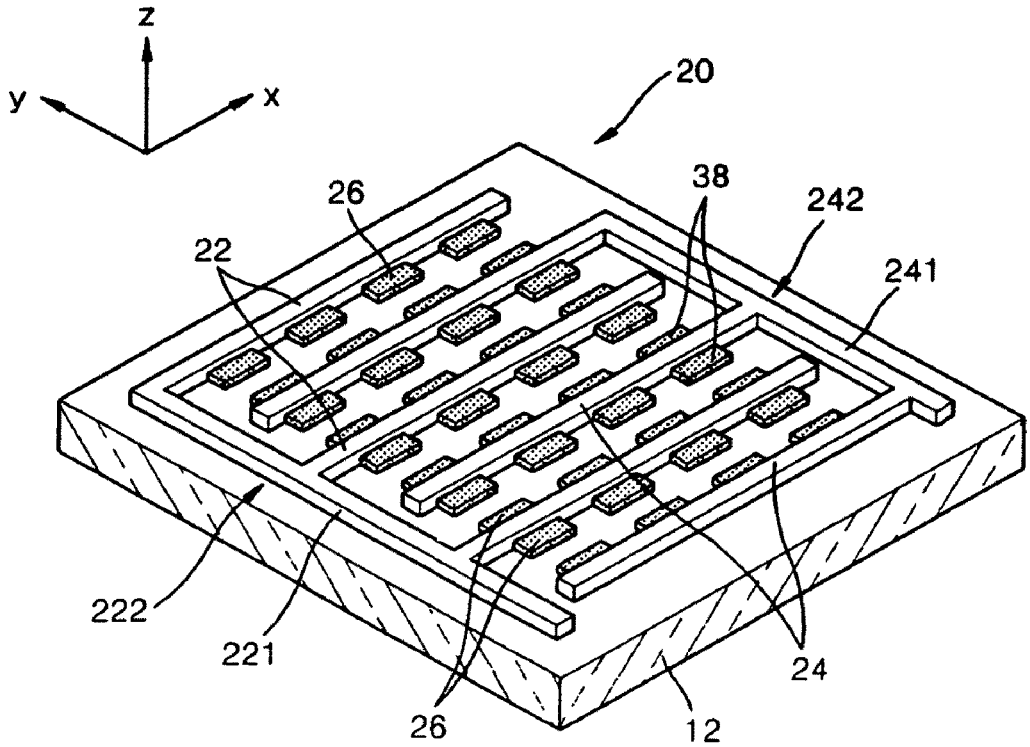
FIG. 2 is a perspective view of an electron emission device of FIG. 1.
Figure 3:
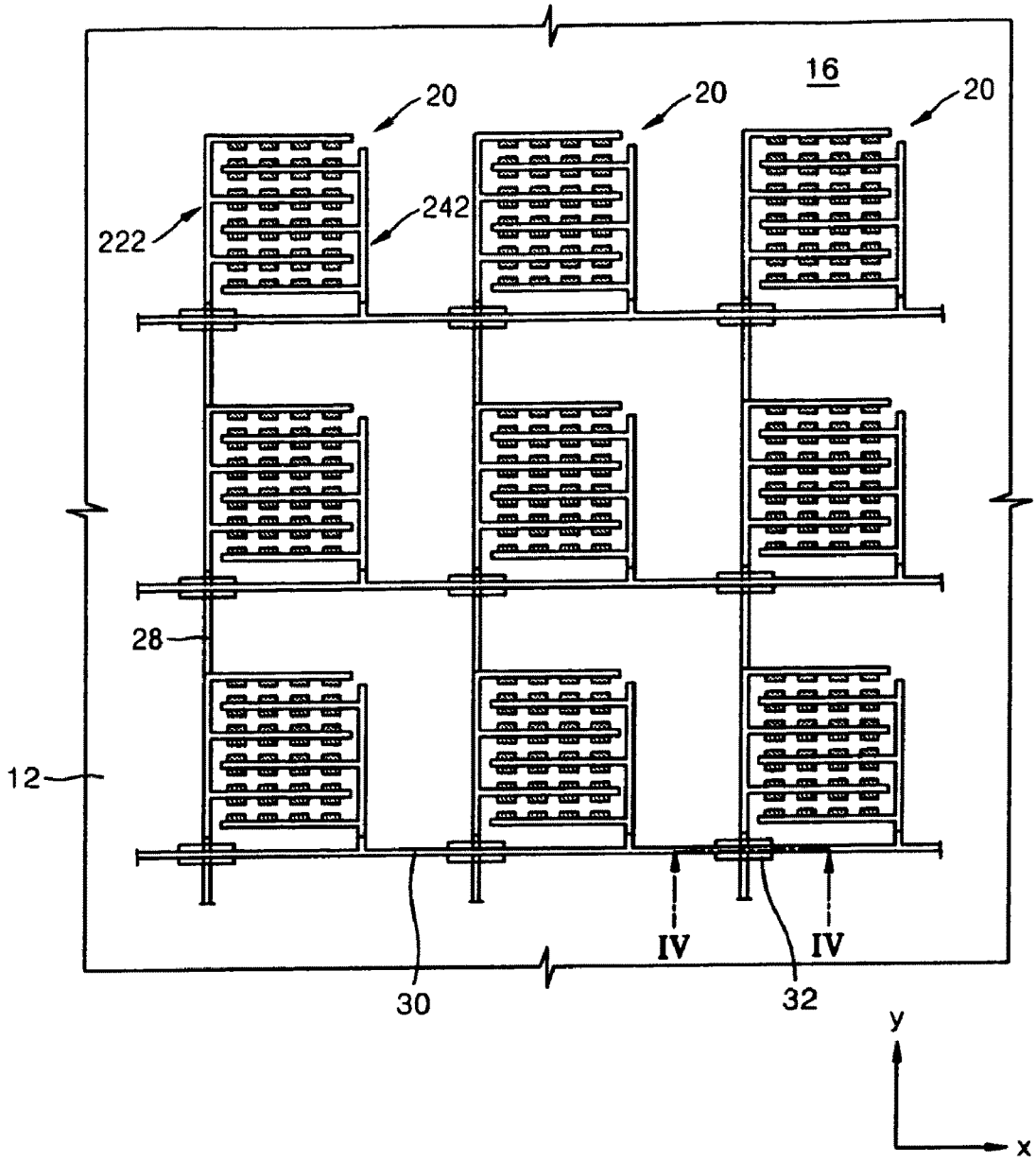
FIG. 3 is a partial plan view of an electron emission unit which include the electron emission devices of FIG. 2.

Referring to FIGS. 1, 2 and 3, a light emission apparatus 102 includes a first substrate 12 and a second substrate 14, which are spaced apart from each other and are disposed parallel to each other. A sealing member (not shown) is disposed at edges of the first substrate 12 and the second substrate 14 to bond both the first and second substrates 12, 14. An inner space is exhausted to produce a vacuum of $10^{-6}$ torr so that the sealing member and the first and second substrates 12, 14 form a vacuum container.

An area disposed inside the sealing member, which includes one of the first and second substrates 12, 14, is divided into a display area that contributes to the virtual emission of visible light and a non-display area surrounding the display area. In a display area of the inner surface of the first substrate 12, an electron emission unit 16 (see FIG. 3) for emitting electrons is disposed. In a display area of the inner surface of the second substrate 14, a light emission unit 18 for emitting visible light is disposed.

The electron emission unit 16 includes a plurality of electron emission devices 20 in which an amount of emission current is independently controlled. The light emission unit 18 is disposed in the second substrate 14 opposing the first substrate 12. The light emission unit 18 receives electrons from the electron emission devices 20 included in the first substrate 12, and emits visible light. In exemplary embodiments the visible light transmits through a transparent first substrate 12 and/or a transparent second substrate 14 and is emitted to the outside of the light emission apparatus 102.

In the present embodiment, the electron emission unit 16 operates in a bipolar driving mode. The light emission unit 18 maximizes reflection efficiency of visible light and increases brightness of a light emissive surface.

In more detail, each of the electron emission devices 20 include first electrodes 22 that are spaced apart from each other in a first direction (y direction) on the first substrate 12. Second electrodes 24 are disposed among the first electrodes 22 in the first direction on the first substrate 12. First electron emitters 26 are disposed on the side surfaces of the first electrodes 22 facing the second electrodes 24 and are less thick than the first electrodes 22. Second electron emitters 38 are disposed on the side surfaces of the second electrodes 24 facing the first electrodes 22 and are less thick than the second electrodes 24.

Gaps between the first and second electron emitters 26, 38 prevent a short circuit from occurring therebetween so that the first and second electron emitters 26, 38 are spaced apart from each other by a predetermined interval.

Figure 8:
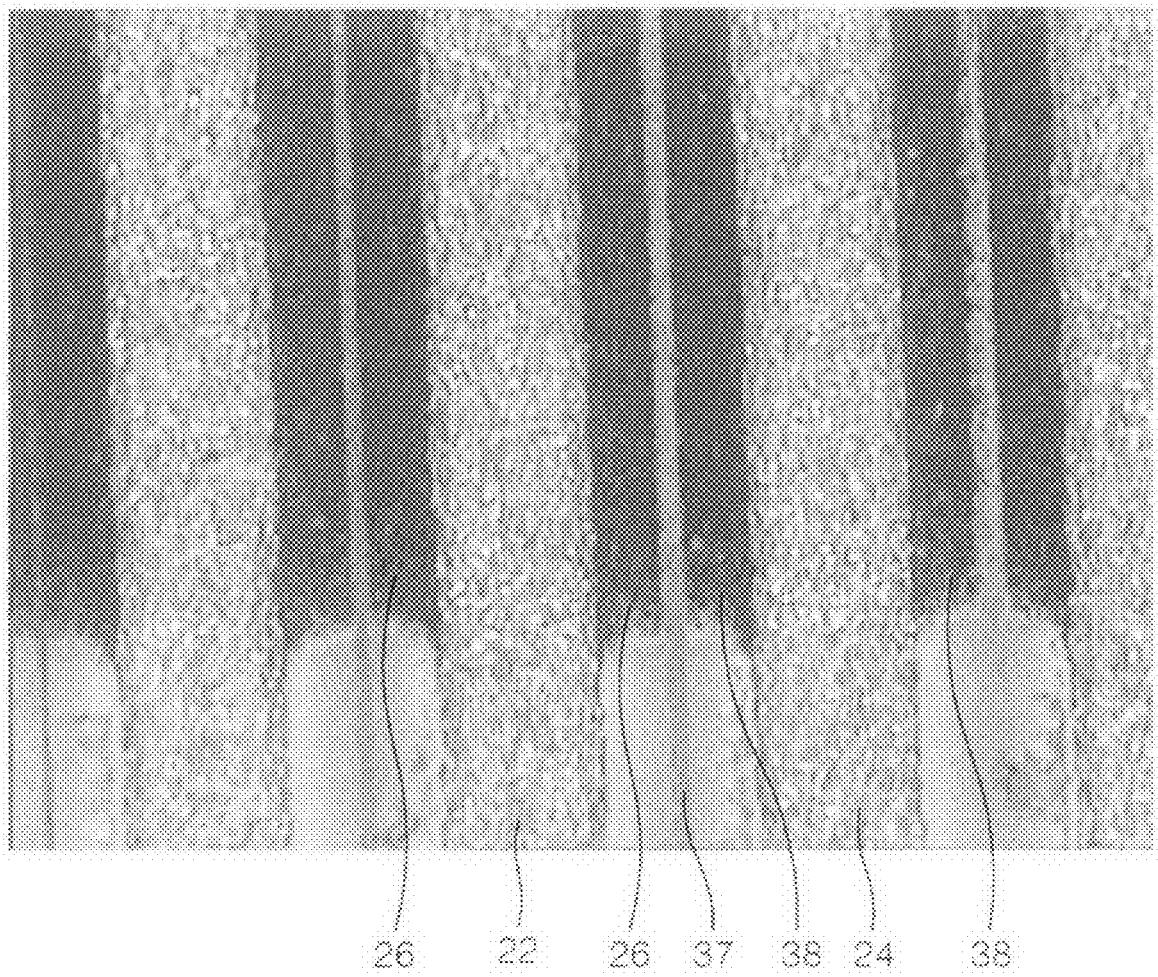
FIG. 8 is a partial enlarged view of electron light emission apparatuses manufactured using a method of manufacturing electron emission devices according to an embodiment of the present invention.

The first electron emitters 26 may be formed in a continuous line pattern in a lengthwise direction along the first electrodes 22 as seen in the exemplary embodiment as shown in FIG. 8, or, in the exemplary embodiment as shown in FIG. 2, may be formed in a discontinuous pattern such that the electron emitters 26 are spaced apart from each other in the lengthwise direction along the first electrodes 22. Likewise, the second electron emitters 38 may be formed a continuous line pattern in a lengthwise direction along the second electrodes 24 as seen in the exemplary embodiment of FIG. 8, or, in the exemplary embodiment of FIG. 2, may be formed in a discontinuous pattern such that the electron emitters 38 are spaced apart from each other in the lengthwise direction along the second electrodes 24.

When the first substrate 12 is a front substrate and the second substrate 14 is a rear substrate, and light is emitted to the first substrate 12, the first and second electron emitters 26, 38 are formed with a plurality of patterns that are spaced apart from each other so that the first substrate 12 is exposed via the gaps between the first and second electron emitters 26, 38 to increase transparency of visible light.

Referring to FIG. 2, a first connection electrode 221 is disposed at one end of the first electrodes 22 so that the first connection electrode 221 and the first electrodes 22 form a first electrode set 222. A second connection electrode 241 is disposed at one end of the second electrodes 24 so that the second connection electrode 241 and the second electrodes 24 form a second electrode set 242.

On the first substrate 12, the height of the first and second electrodes 22, 24 is greater than that of the first electron emitters 26. The first and second electrodes 22, 24 may be formed by a thin film process, such as sputtering or vacuum deposition, by a thick film process, such as screen printing or laminating, or by other various methods known to those skilled in the art. In an exemplary embodiment the first and second electrodes 22, 24 may have a thickness in the range of about 3 μm to about 12 μm The first electron emitters 26 may be formed of materials that emit electrons when an electric field is applied while vacuuming, such as carbon group materials or nanometer size materials. The first electron emitters 26 may be formed of a material selected a group consisting of carbon nano tubes, graphite, graphite nano fiber, fullerene $C_{60}$, silicon nano wires, and a combination thereof.

On the other hand, the first electron emitters 26 may include a carbide-derived carbon. The carbide-derived carbon can be prepared by a thermochemical reaction between a carbide compound and a halogen group element containing gas to extract all elements except carbon included in the carbide compound.

The carbide compound may be at least one carbide compound selected from a group of $SiC_4$, $B_4C$, TiC, $ZrC_x$, $Al_4C_3$, $CaC_2$, $Ti_xTa_yC$, $Mo_xW_yC$, $TiN_xC_y$, and $ZrN_xC_y$. The halogen group element containing gas may be $Cl_2$, $TiCl_4$, or $F_2$. The first electron emitters 26 including the carbide-derived carbon have excellent electron emission uniformity and long lifetime.

The first electron emitters 26 may be formed using a screen printing method and may be formed of a thickness in the range of about 1 μm to about 2 μm. However, a method of forming the first electron emitters 26 is not limited to the screen printing method and the first electron emitters 26 may be formed using a variety of methods known to those skilled in the art.

The electron emission devices 20 having the above structure are disposed parallel to each other by a predetermined space in the display area of the first substrate 12. First wiring portions 28 and second wiring portions 30 are disposed between the electron emission devices 20 in order to apply a driving voltage to the first and second electrodes 22, 24.

Figure 4:
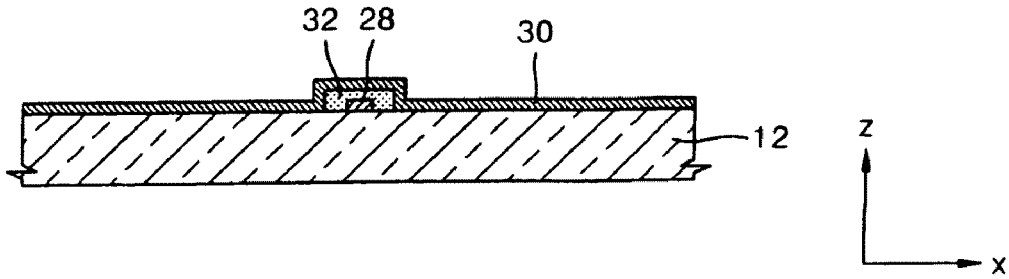
FIG. 4 is a cross-sectional view of a portion of the electron emission unit taken along IV-IV line of FIG. 3.

FIG. 4 is a cross-sectional view of the electron emission unit taken along IV-IV line of FIG. 3.

Referring to FIGS. 3 and 4, the first wiring portions 28 are formed in a first direction (y axis direction) of the first substrate 12, and are electrically connected to the first electrode set 222 of the electron emission devices 20 disposed in the first direction of the first substrate 12. The second wiring portions 30 are formed in a second direction (x axis direction) perpendicular to the first direction of the first substrate 12, and are electrically connected to the second electrode set 242 of the electron emission devices 20 disposed in the second direction perpendicular to the first direction of the first substrate 12.

An insulating layer 32 is formed between the first and second wiring portions 28, 30 in an area where the first and second wiring portions 28, 30 cross each other in order to prevent a short circuit from occurring between the first and second wiring portions 28, 30. The thickness of the insulating layer 32 is greater than the thickness of the first and second wiring portions 28, 30.

Referring back to FIG. 1, the light emission unit 18 includes a metal reflection film 34 that is formed inside the second substrate 14 and a phosphor layer 36 that is formed on one surface of the metal reflection film 34 facing the first substrate 12.

The phosphor layer 36 may be formed of a combination phosphor that includes a red phosphor, a green phosphor, and a blue phosphor, and emits white light, and may be disposed throughout the display area of the second substrate 14. The metal reflection film 34 to which an anode voltage is applied from a power supply disposed outside the vacuum container serves as an anode electrode.

The metal reflection film 34 may be formed of a transparent conductive material such as indium tin oxide (ITO) in order to transmit visible light emitted from the phosphor layer 36.

The metal reflection film 34 may alternatively be formed of aluminum of thickness of several thousand angstroms (Å), and includes fine holes for transmitting an electronic beam. While the metal reflection film 34 serves as the anode electrode in the present embodiment, an anode electrode layer other than the metal reflection film 34 may be formed in the present invention.

Spacers (not shown) disposed between the first and second substrates 12, 14 support a compression force applied to the vacuum container, and maintains a constant spacing between the first and second substrates 12, 14.

The light emission apparatus 102 having the above structure forms a pixel including each of the electron emission devices 20 and the phosphor layer 36 corresponding to each of the electron emission devices 20. The light emission apparatus 102 applies a scan driving voltage to one of the first and second wiring portions 28, 30, and applies a data driving voltage to another one of the first and second wiring portions 28, 30, and applies a direct current voltage (anode voltage) of more than 10 kV to the metal reflection film 34.

An electric field is formed around the first electron emitters 26 of pixels in which a voltage difference between the first and second electrodes 22, 24 is greater than a threshold value so that electrons (marked with $e^-$ in FIGS. 5 and 6) are emitted as a result of the electric field. The electrons are drawn to the anode voltage applied to the metal reflection film 34 and collide with the corresponding phosphor layer 36 so that the phosphor layer 36 is excited to emit visible light. The visible light emitted from the phosphor layer 36 transmits through the second substrate 14 and/or the first substrate 12.

Figure 5:
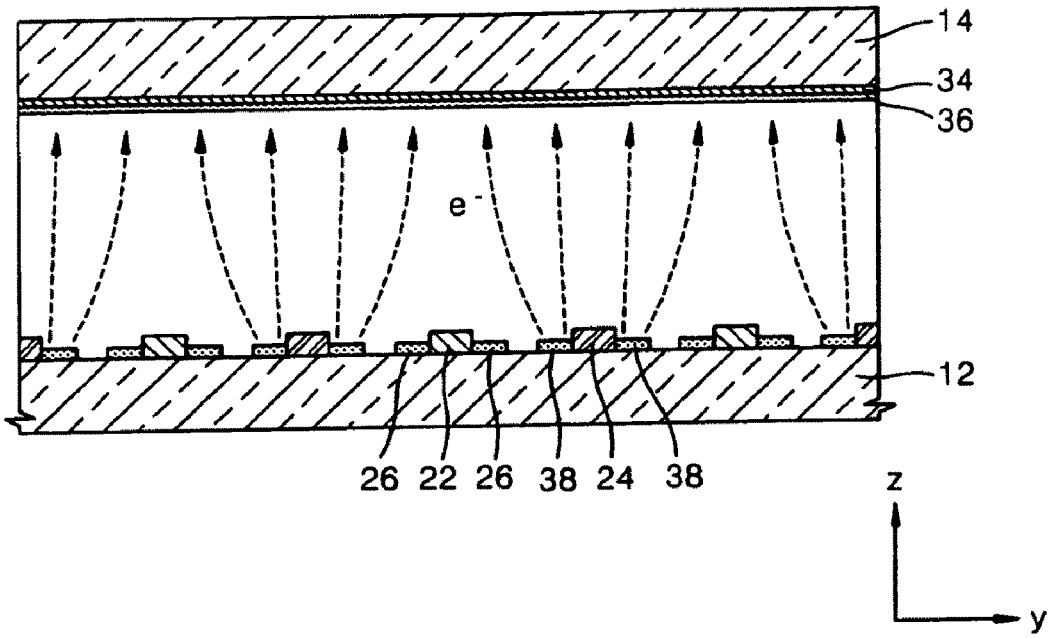
FIGS. 5 and 6 are partial perspective views of a light emission apparatus when operated, according to an embodiment of the present invention.
Figure 6:
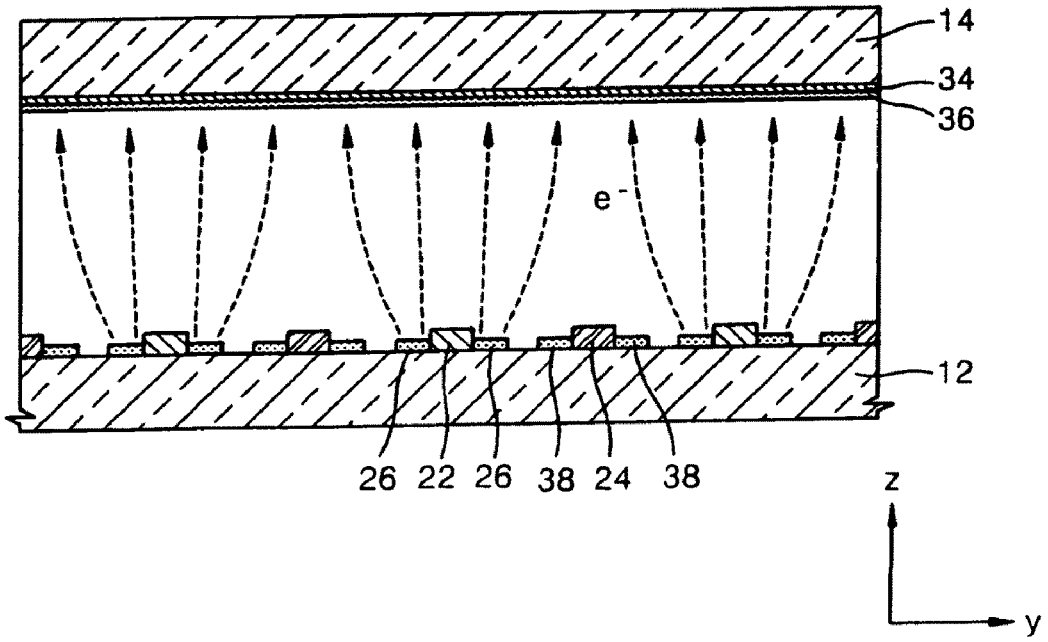

FIGS. 5 and 6 are partial perspective views of a light emission apparatus in operation according to an embodiment of the present invention.

Referring to FIGS. 5 and 6, the light emission apparatus 102 of the present embodiment uses a driving method of alternately repeating inputting a scan driving voltage and a data driving voltage to the first and second electrodes 22, 24. A low voltage between the scan driving voltage and the data driving voltage is applied to cathode electrodes, and a high voltage therebetween is applied to gate electrodes.

In more detail, the light emission apparatus 102 may apply the scan driving voltage to the first electrodes 22 through the first wiring portions 28 and apply the data driving voltage to the second electrodes 24 through the second wiring portions 30 at a first time period. Thereafter, the light emission apparatus 102 may apply the scan driving voltage to the second electrodes 24 through the second wiring portions 30 and apply the data driving voltage to the first electrodes 22 through the first wiring portions 28 at a second time period.

If the scan driving voltage is higher than the data driving voltage, the second electrodes 24 are cathode electrodes at the time period t1, electrons (marked with $e^-$ in FIG. 5) are emitted from the second electron emitters 38, and the phosphor layer 36 is excited. The first electrodes 22 are cathode electrodes at the time period t2, electrons (marked with $e^-$ in FIG. 6) are emitted from the first electron emitters 26, and the phosphor layer 36 is excited.

The first and second time periods are repeatedly operated so that the electrons are alternately emitted from the first and second electron emitters 26, 38. In such a bipolar driving mode, loads that are applied to each of the first and second electron emitters 26, 38 are reduced, thereby increasing lifetime of the first and second electron emitters 26, 38, and enhancing brightness of a light emissive surface.

In the embodiments described above, the thickness of the first and second electron emitters 26, 38 is smaller than that of the first and second electrodes 22, 24. In this regard, the first electrodes 22 and the first electron emitters 26 have a thickness difference approximately between 1 μm through 10 μm, and the second electrodes 24 and the second electron emitters 38 have a thickness difference approximately between 1 μm through 10 μm.

If the thickness difference between the first and second electron emitters 26, 38 and the first and second electron emitters 26, 38 is smaller than 1 μm, a reduction of shielding effect of the anode electric field reduces high voltage reliability, making it impossible to accomplish high brightness, high efficiency, and high lifetime. If the thickness difference between the first and second electron emitters 26, 38 and the first and second electron emitters 26, 38 is greater than 10 μm, an increase in the distance therebetween may increase a driving voltage.

In the above structure, the first and second electrodes 22, 24, which are disposed on the first substrate 12 and have a height greater than the first and second electron emitters 26, 38, change distribution of the electric filed around the first and second electron emitters 26, 38 and reduce an influence of the anode electric field with regard to the first and second electron emitters 26, 38.

Therefore, when the anode voltage more than 10 kV is applied to the metal reflection film 34 in order to increase brightness of a light emissive surface, the first and second electrodes 22, 24 attenuate the anode electric field around the first and second electron emitters 26, 38, thereby effectively preventing diode emission by the anode electric field.

The light emission apparatus 102 of the present embodiment increases the anode voltage and brightness of the light emissive surface, prevents the diode emission, and precisely controls brightness per pixel. Further, the light emission apparatus 102 increases the high voltage reliability, minimizes arcing occurred inside the vacuum container, and prevents damage of an inner structure due to the arcing.

A method of manufacturing the electron emission devices 20 of the light emission apparatus 102 will now be described with reference to FIGS. 7A through 7C.

Figure 7A:
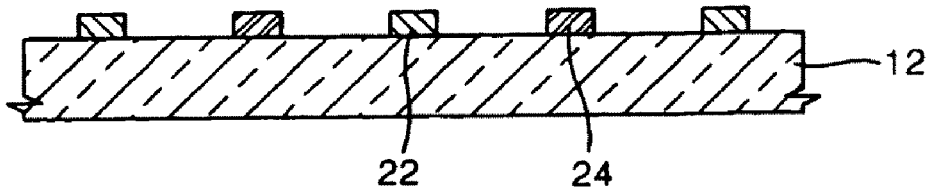
FIGS. 7A, 7B and 7C are partial cross-sectional views of depicting a method of manufacturing electron emission devices of a light emission apparatus, according to an embodiment of the present invention.

Referring to FIG. 7A, a metal paste is screen printed and a conductive film is formed on the first substrate 12. The conductive film is patterned and the first and second electrodes 22, 24 are simultaneously or sequentially formed. The first and second electrodes 22, 24 are formed alternatively parallel to each other. The metal paste may include silver (Ag). The thickness of the first and second electrodes 22, 24 is approximately between 3 through 12 μm.

Figure 7B:
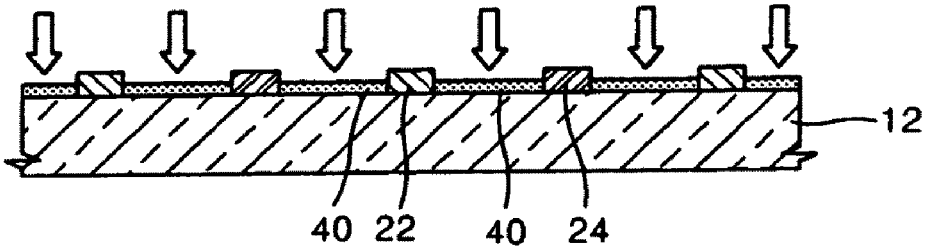

Referring to FIG. 7B, electron emission layers 40 are formed between the first and second electrodes 22, 24. The electron emission layers 40 may be formed by (a) screen printing a paste compound including an electron emission material and a sensitive material on the first substrate 12, (b) hardening a part of the paste compound by irradiating ultraviolet rays from the outer surface of the first substrate 12, and (c) removing a part of the compound that is not hardened using a developer.

The electron emission material may be formed of a material selected a group consisting of carbon nano tubes, graphite, graphite nano fiber, diamond, diamond like carbon, fullerene, silicon nano wires, and a combination thereof. Alternatively, a carbide-derived carbon may be used as the electron emission material. The carbide-derived carbon is more appropriate for forming an electron emission layer using the inkjet method than carbon nanotubes used as materials of a conventional electron emitter. That is because carbon nanotubes are a fiber type having a high aspect ratio, but the carbide-derived carbon is a plate type having an aspect ratio of about 1 to have a very small field enhancement factor β. In addition, the carbide-derived carbon regulates easily the size of the final electron emission material by selectively applying carbide as a precursor of the electron emission material.

When the electron emission layers 40 are formed, a printing thickness of the paste compound and time taken to irradiate ultraviolet rays are controlled so that the thickness of the electron emission layers 40 is smaller than the thickness of the first and second electrodes 22, 24. In an exemplary embodiment the thickness of the electron emission layers 40 may be approximately between 1 μm and 2 μm.

A variety of processes may be considered to form the electron emission layers 40 because a subsequent process to the process for forming the electron emission layers 40 removes a part of the electron emission layers 40 using laser and forms gaps between the electron emission layers 40, which does not require a method of forming a specific electron emission layer in order to form the gaps. Further, since the method of forming the electron emission layers 40 is not limited, a variety of materials can be used as the electron emission material as described above.

Figure 7C:
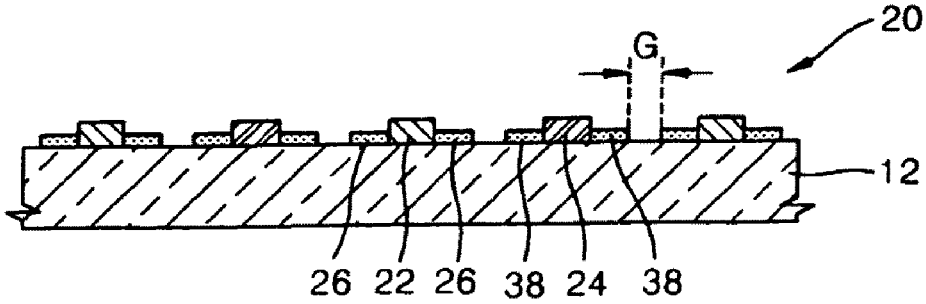

The center of the electron emission layers 40 onto which laser is irradiated (see an arrow shown in FIG. 7B) is laser ablated, thereby forming the first and second electron emitters 26, 38 as shown in FIG. 7C. The first and second electron emitters 26, 38 may be spaced apart from each other by a gap smaller than approximately 20 μm. The gap G (see FIG. 7C) may be in an exemplary embodiment between 3 through 20 μm. The electron emission devices 20 are completely manufactured through the above processes.

The gap may be more precisely controlled. In the present embodiment, the method of manufacturing the electron emission devices 20 irradiates by a laser and forms the gap so that the width of the gap can be precisely controlled. In particular, the gap having the width less than 20 μm can be formed only by irradiating by laser. The gap having the width less than 3 μm can easily cause a short circuit between first and second electron emitters 26, 38. Thus, the width of the gap may be greater than 3 μm.

FIG. 8 is a partial enlarged view of electron light emission apparatuses manufactured using a method of manufacturing electron emission devices according to an embodiment of the present invention.

Like reference numerals in FIGS. 2 and 8 denote like elements, and thus their description will be omitted.

With reference to FIGS. 2 and 8, the method of manufacturing the electron emission devices 20 forms the electron emission layers 40 between the first and second electrodes 22, 24, irradiates laser onto a part of the electron emission layers 40, patterns the part of the electron emission layers 40, and forms gaps. In the process of irradiating laser and patterning the part of the electron emission layers 40, a laser cut depth of the electron emission layers 40 is precisely controlled in order to avoid damage of the first substrate 12. However, in the above process, patterns 37 may be formed on the first substrate 12 in which the electron emission layers 40 is formed. For example, the patterns 37 may be sulfurated with a dark color. In this case, a part of the electron emission layers 40 is removed and gaps are formed, and the first and second electron emitters 26, 38 are formed in both sides of the gaps. Therefore, since the patterns 37 are formed due to the laser cut effect, the patterns 37 are arranged in the gaps.

The pattern 37 may be a specific evidence for determining whether the electron emission devices 20 are manufactured using the process of irradiating laser and removing a part of the electron emission layers 40.

Although not shown, as another embodiment of the method of manufacturing the electron emission devices 20, referring to FIGS. 7A through 7C, ITO electrodes are formed on the first substrate 12, a metal paste is screen printed on the ITO electrodes, and a conductive film is formed. The conductive film is patterned and the first and second electrodes 22, 24 are simultaneously or sequentially formed.

The electron emission layers 40 are formed between the first and second electrodes 22, 24. The electron emission layers 40 may be formed to bury the first and second electrodes 22, 24. Thereafter, the laser is irradiated onto the center of the electron emission layers 40 formed between the first and second electrodes 22, 24, a part of the electron emission layers 40 and the ITO electrodes is removed, gaps are formed between the first and second electrodes 22, 24, and gaps are formed between the ITO electrodes. When the ITO electrodes are used as auxiliary electrodes, bonding efficiency between an emitter material and electrodes increases, enhancing light emission efficiency of a surface light source.

The method of manufacturing electron emission devices according to the present invention can be integratedly applied by a variety of methods of manufacturing electron emitters and is not limited to a material of electron emission devices.

The electron emission devices and light emission apparatus according to the present invention make it possible to manufacture electron emission units using any methods, enabling to use an insensitive/low temperature resolving binder when electron emission layers are covered with screen printing, thereby minimizing a char on the surface of an electron emission unit and increasing emission efficiency of electrons.

The electron emission units electrically serve as equivalent electrodes, so that a resolution of gaps between first and second electrodes can be precisely controlled by irradiation of laser.

The electron emission devices and light emission apparatuses according to the present invention pattern a paste including a carbide-driven carbon, as a material of the electron emission units, to the structure of the present invention, thereby improving inconsistent emission performance and more easily constituting a cold cathode structure than a conventional cold cathode structure.

The method of manufacturing electron emission devices according to the present invention can replace an operation of forming the electron emission units that requires a conventional exposure/developing process with an insensitive process, which does not need an expensive device such as an exposure device, thereby reducing manufacturing costs.

In the electron emission devices and light emission apparatus according to the present invention, the electron emitters face each other, making bipolar driving possible, which increases lifetime and brightness of the electron emission units.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electron emission device, comprising:

first electrodes on a substrate, the first electrodes extending in a first direction and spaced apart from each other;

second electrodes on the substrate alternating between the first electrodes and extending in a second direction opposing the first direction; and first electron emitters and second electron emitters on side surfaces of the first electrodes and the second electrodes, respectively, the first electron emitters and the second electron emitters being separated by gaps, the first electron emitters and second electron emitters having a height lower than that of the first and second electrodes, and being spaced apart from each other in a lengthwise direction along the first and second electrodes, respectively, the first and second electron emitters being offset from the first and second electrodes in a widthwise direction.

2. The electron emission device of claim 1, wherein a width of the gaps is less than 20 μm.

3. The electron emission device of claim 1, wherein a width of the gaps is between about 3 μm and 20 μm.

4. The electron emission device of claim 1, further comprising patterns arranged in at least one of the gaps on the surface of the substrate.

5. The electron emission device of claim 1, wherein the first electron emitters and second electron emitters include a carbide-derived carbon.

6. A light emission apparatus comprising:

a first substrate and a second substrate facing each other;

an electron emission unit on a surface of the first substrate and including a plurality of electron emission devices;

a metal reflection film on a surface of the second substrate; and a light emission unit having phosphor layers on a surface of the metal reflection film facing the first substrate, wherein each of the electron emission devices comprises:

first electrodes on the first substrate, the first electrodes extending in a first direction and spaced apart from each other;

second electrodes on the first substrate alternating between the first electrodes and extending in a second direction opposing the first direction; and first electron emitters and second electron emitters on side surfaces of the first electrodes and the second electrodes, respectively, the first electron emitters and second electron emitters being separated by gaps, the first electron emitters and second electron emitters having a height lower than that of the first and second electrodes, and being spaced apart from each other in a lengthwise direction along the first and second electrodes, respectively, the first and second electron emitters being offset from the first and second electrodes in a widthwise direction.

7. The light emission apparatus of claim 6, wherein a width of the gaps is less than 20 μm.

8. The light emission apparatus of claim 5, wherein the width of the gaps is between about 3 μm and 20 μm.

9. The light emission apparatus of claim 6, further comprising patterns arranged in at least one of the gaps on the surface of the first substrate.

10. The light emission apparatus of claim 6, wherein the first electron emitters and second electron emitters include a carbide-derived carbon.

* * * * *

UNITED STATES PATENT AND TRADEMARK OFFICE

CERTIFICATE OF CORRECTION

PATENT NO. : 7,960,906 B2
APPLICATION NO. : 12/145687
DATED : June 14, 2011
INVENTOR(S) : Lee et al.

It is certified that error appears in the above-identified patent and that said Letters Patent is hereby corrected as shown below:

In the Claims

Column 10, Claim 6, lines 29. Before "second" Insert -- the --

Column 10, Claim 8, line 39. Delete "claim 5" Insert -- claim 6 --

Signed and Sealed this
Tenth Day of April, 2012

David J. Kappos

David J. Kappos
*Director of the United States Patent and Trademark Office*